US011326235B2

(12) United States Patent
Hirashima et al.

(10) Patent No.: US 11,326,235 B2
(45) Date of Patent: May 10, 2022

(54) HOT ROLLED STEEL SHEET AND METHOD FOR MANUFACTURING SAME

(71) Applicant: NIPPON STEEL CORPORATION, Tokyo (JP)

(72) Inventors: Tetsuya Hirashima, Tokyo (JP); Takeshi Toyoda, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 33 days.

(21) Appl. No.: 16/626,469

(22) PCT Filed: Aug. 9, 2018

(86) PCT No.: PCT/JP2018/029920
§ 371 (c)(1),
(2) Date: Dec. 24, 2019

(87) PCT Pub. No.: WO2019/031583
PCT Pub. Date: Feb. 14, 2019

(65) Prior Publication Data

US 2020/0224294 A1 Jul. 16, 2020

(30) Foreign Application Priority Data

Aug. 9, 2017 (JP) ..... JP2017-154294

(51) Int. Cl.

| | |
|---|---|
| ***C21D 8/02*** | (2006.01) |
| ***C22C 38/16*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/08*** | (2006.01) |
| ***C22C 38/12*** | (2006.01) |
| ***C22C 38/14*** | (2006.01) |

(52) U.S. Cl.
CPC ..... *C22C 38/16* (2013.01); *C21D 8/0226* (2013.01); *C22C 38/001* (2013.01); *C22C 38/02* (2013.01); *C22C 38/04* (2013.01); *C22C 38/06* (2013.01); *C22C 38/08* (2013.01); *C22C 38/12* (2013.01); *C22C 38/14* (2013.01); *C21D 2211/002* (2013.01); *C21D 2211/005* (2013.01); *C21D 2211/008* (2013.01)

(58) Field of Classification Search
None
See application file for complete search history.

(56) References Cited

U.S. PATENT DOCUMENTS

| | | | | |
|---|---|---|---|---|
| 10,000,829 | B2 | 6/2018 | Toda et al. | |
| 2014/0234660 | A1 | 8/2014 | Kawata et al. | |
| 2014/0251513 | A1 | 9/2014 | Kami et al. | |
| 2017/0137906 | A1* | 5/2017 | Fan | B32B 15/013 |
| 2018/0100212 | A1* | 4/2018 | Ono | C22C 38/001 |

FOREIGN PATENT DOCUMENTS

| | | | |
|---|---|---|---|
| CN | 103842541 | A | 6/2014 |
| EP | 3 000 905 | A1 | 3/2016 |
| JP | 5-345917 | A | 12/1993 |
| JP | 2011-52321 | A | 3/2011 |
| JP | 2013-117068 | A | 6/2013 |
| JP | 2014-37589 | A | 2/2014 |
| JP | 2014-205889 | A | 10/2014 |
| JP | 2014-227583 | A | 12/2014 |
| JP | 2017-8343 | A | 1/2017 |
| JP | 2017-66516 | A | 4/2017 |
| JP | 2017-179540 | A | 10/2017 |
| TW | 201502286 | A | 1/2015 |

OTHER PUBLICATIONS

"Metallic materials—Tensile testing—Method of test at room temperature", JIS Z 2241: 2011, total of 37 pages.
"Method for Charpy pendulum Impact test of metallic materials", JIS Z 2242: 2005, total of 26 pages.
International Search Report for PCT/JP2018/029920 (PCT/ISA/210) dated Oct. 23, 2018.
Notice of Allowance issued in Taiwanese Patent Application No. 107127819 dated Jan. 11, 2019.
Written Opinion of the International Searching Authority for PCT/JP2018/029920 (PCT/ISA/237) dated Oct. 23, 2018.

* cited by examiner

*Primary Examiner* — Seth Dumbris
(74) *Attorney, Agent, or Firm* — Birch, Stewart, Kolasch & Birch, LLP.

(57) ABSTRACT

A hot rolled steel sheet according to an aspect of the present invention has a predetermined chemical composition, and a metallographic structure in which martensite is the major structure, wherein an average length of grains in an L direction parallel to a rolling direction is 0.2 μm or more and 5.0 μm or less, an average length of grains in a C direction parallel to a transverse direction is 0.1 μm or more and 5.0 μm or less, the ratio of the average length in the C direction to the average length in the L direction is 0.2 or more and 5.0 or less, and the tensile strength is 1180 MPa or more.

4 Claims, No Drawings

HOT ROLLED STEEL SHEET AND METHOD FOR MANUFACTURING SAME

TECHNICAL FIELD OF THE INVENTION

The present invention relates to a hot rolled steel sheet which is suitable as a material for structural components and frames of vehicles and truck frames, and is excellent in strength and toughness and also excellent toughness isotropy, and a method for manufacturing the same.

Priority is claimed on Japanese Patent Application No. 2017-154294, filed on Aug. 9, 2017, the content of which is incorporated herein by reference.

RELATED ART

From the viewpoint of global environmental protection, regulations on vehicle exhaust gas have been tightened, and an improvement in fuel efficiency of vehicles has been an issue. Under such circumstances, there is a demand for a high-strenthening and a thinning of a steel sheet for a vehicle, and high strength hot rolled steel sheets have been particularly actively applied as materials for vehicle components. In particular, a high strength hot rolled steel sheet having a tensile strength of 1180 MPa or more has attracted attention as a material that can dramatically improve the fuel efficiency of vehicles.

However, generally, the toughness decreases as the strength of the steel sheet increases. For this reason, various studies have been made to provide toughness required for vehicle components.

For example, Patent Document 1 suggests a method for manufacturing a high strength hot rolled steel sheet in which a steel piece including C: 0.05% to 0.20%, Si: 0.60% or less, Mn: 0.10% to 2.50%, sol. Al: 0.004% to 0.10%, Ti: 0.04% to 0.30%, B: 0.0005% to 0.0015%, and a remainder consisting of iron and unavoidable impurities is heated in a temperature range from at least 1100° C. to a heating temperature which is equal to or higher than a solutionizing temperature of TiC and equal to or less than 1400° C. at a temperature rising rate of 150° C./h or more, is retained at the heating temperature for a retention time of 5 minutes or longer and 30 minutes or shorter, and is thereafter hot rolled. In addition, Patent Document 1 discloses that a ferrite structure is refined by using a small amount of Ti as a precipitation strengthening element and a small amount of solute B as an austenite stabilizing element that lowers a transformation temperature during cooling, whereby the high strength hot rolled steel sheet having a strength as high as a tensile strength of about 1020 MPa and a toughness as high as a fracture appearance transition temperature of about −70° C. is obtained.

Patent Document 2 suggests a method for manufacturing a high strength hot rolled steel sheet in which a steel piece including, by mass %, C: 0.05% to 0.18%, Si: 1.0% or less, Mn: 1.0% to 3.5%, P: 0.04% or less, S: 0.006% or less, Al: 0.10% or less, N: 0.008% or less, Ti: 0.05% to 0.20%, V: more than 0.1% to 0.3%, and a remainder consisting of iron and unavoidable impurities is heated to 1200° C. or higher, is subjected to hot rolling including rough rolling and finish rolling with a cumulative rolling reduction of 50% or more at 1000° C. or lower and a finish rolling finishing temperature of 820° C. or higher and 930° C. or lower, is started to be cooled within 4.0 seconds, is cooled at an average cooling rate of 20° C./s or more, and is wound at 300° C. or higher and 450° C. or lower, whereby the high strength hot rolled steel sheet has a metallographic structure primarily containing bainite, having an average lath spacing between laths of the bainite of 400 nm and an average lath major axis length of 5.0 μm and has excellent toughness.

Patent Document 3 suggests a method for manufacturing a high strength hot rolled steel sheet in which a steel piece including, by mass %, C: 0.08% to 0.25%, Si: 0.01% to 1.0%, Mn: 0.8% to 1.5%, P: 0.025% or less S: 0.005% or less, Al: 0.005% to 0.10%, Nb: 0.001% to 0.05%, Ti: 0.001% to 0.05%, Mo: 0.1% to 1.0%, Cr: 0.1% to 1.0%, B: 0.0005% to 0.0050%, and a remainder consisting of iron and unavoidable impurities is heated to 1100° C. to 1250° C., is subjected to finish rolling with a finish rolling input side temperature in a range of 900° C. to 1100° C., a finish rolling output side temperature in a range of 800° C. to 900° C., and a cumulative rolling reduction of 60% to 90% in a recrystallization austenite region, is thereafter immediately started to be cooled, is cooled to a cooling stop temperature of (Ms point+50° C.) or lower within 30 seconds from the start of the cooling at a cooling rate equal to or more than a martensite generation critical cooling rate, is then retained in a temperature range of (the cooling stop temperature ±100° C.) for 10 to 60 seconds, and is thereafter wound, whereby the high strength hot rolled steel sheet has a metallographic structure containing martensite or tempered martensite as a primary phase and a prior austenite grain aspect ratio of 3 to 18 in a cross section in a rolling direction and has excellent low temperature toughness.

PRIOR ART DOCUMENT

Patent Documents

[Patent Document 1] Japanese Unexamined Patent Application, First Publication No. H5-345917

[Patent Document 2] Japanese Unexamined Patent Application, First Publication No. 2014-205889

[Patent Document 3] Japanese Unexamined Patent Application, First Publication No. 2011-52321

DISCLOSURE OF THE INVENTION

Problems to be Solved by the Invention

However, in the techniques described in Patent Documents 1 and 2, the metallographic structure primarily contains ferrite and bainite, and there are cases where it is difficult to manufacture a hot rolled steel sheet having both high strength and high toughness.

Furthermore, in the technique described in Patent Document 3, the addition of Nb, Ti, Mo, and Cr is essential, which is not preferable from the viewpoint of economy, and there are cases where the toughness is not excellent in both a direction (L direction) parallel to a rolling direction of the steel sheet and a direction (C direction) parallel to a transverse direction and the anisotropy of the toughness is large.

An object of the present invention is to solve the problems of the related art, and provide a hot rolled steel sheet which is excellent in strength and toughness and also excellent in isotropy of the toughness and has a relatively low amount of alloy, and a method for manufacturing the same.

Means for Solving the Problem

In order to solve the above problems, the present inventors intensively studied various factors that affect the toughness of a high strength hot rolled steel sheet As a result, the present inventors found that in grain size measurement by image analysis in the related art as in Patent Document 3, in a case where the metallographic structure is a complex structure containing martensite, the aspect ratio of a grain size and the anisotropy of toughness do not have a correlation. Therefore, the present inventors paid attention to a section method for measuring the one-dimensional lengths of grains in a cross section of a sample, calculated the average length of grains in a direction (L direction) parallel to a rolling direction and the average length of grains in a direction (C direction) parallel to a transverse direction, examined the ratio therebetween and the anisotropy of toughness, and found that there is a strong correlation therebetween. Specifically, the present inventors defined one having an orientation difference of 5° or more from adjacent grains as one grain, and found that a hot rolled steel sheet having a tensile strength of 1180 MPa or more as its strength and being excellent in toughness and isotropy of the toughness can be obtained by having a metallographic structure in which the average length of grains in a direction (L direction) parallel to a rolling direction is 0.2 μm or more and 5.0 μm or less, the average length of grains in a direction (C direction) parallel to a transverse direction is 0.1 μm or more and 5.0 μm or less, the ratio between the average length (L direction grain length) of the grains in the L direction and the average length (C direction grain length) of the grains in the C direction is 0.2≤C direction grain length/L direction grain length ≤5.0, and martensite is contained as a primary phase.

Furthermore, the present inventors found that in order to manufacture a hot rolled steel sheet having the above-described metallographic structure, it is important to adjust the amounts of C, Si, Mn, P, S, Al, N, and Ti within appropriate ranges, to perform finish rolling in which a cumulative rolling reduction is 70% or more in a non-recrystallization γ region, an interpass time is 0.2 seconds or longer and 10.0 seconds or shorter, and an A value represented by Formula (1) satisfies 0.05≤A≤23.0 in each pass, to immediately start cooling at a cooling rate equal to or more than a martensite generation critical cooling rate V (° C./s), and to wind at a winding temperature of 300° C. or lower.

[Formula 1]

$$A = \frac{2\pi n}{60\sqrt{rH}} \ln\left(\frac{1}{1-r}\right) \quad (1)$$

In Formula (1), n is the roll rotation speed (rpm), r is the rolling reduction (%), and H is the rolling input side sheet thickness (mm).

The present invention has been completed based on the above findings and further examinations. That is, the gist of the present invention is as follows.

[1] A hot rolled steel sheet according to an aspect of the present invention includes, as a chemical composition, by mass %: C: 0.06% or more and 0.20% or less; Si: 1.0% or less; Mn: more than 1.5%, 3.5% or less; P: 0.040% or less; S: 0.004% or less; Al: 0.10% or less; N: 0.004% or less; Ti: 0.04% or more and 0.20% or less; Nb: 0% or more and 0.04% or less; Mo: 0% or more and 1.0% or less; Cu: 0% or more and 0.5% or less; Ni: 0% or more and 0.5% or less; and a remainder consisting of Fe and impurities, in which a metallographic structure at a sheet thickness ¼ depth position and a sheet width center position of the hot rolled steel sheet consists of 90 vol % or more martensite and 0 vol % or more and 10 vol % or less of a residual structure, the residual structure is one or both of bainite and ferrite, an average length of grains in an L direction, which is a direction parallel to a rolling direction, is 0.2 μm or more and 5.0 μm or less, an average length of grains in a C direction, which is a direction parallel to a transverse direction, is 0.1 μm or more and 5.0 μm or less, a ratio between an L direction grain length, which is the average length of the grains in the L direction, and a C direction grain length, which is the average length of the grains in the C direction, is 0.2≤C direction grain length/L direction grain length ≤5.0, and a tensile strength is 1180 MPa or more.

[2] In the hot rolled steel sheet according to [1], in the metallographic structure at the sheet thickness ¼ depth position and the sheet width center position, when the average length of prior austenite grains in the L direction is referred to as an L direction priory grain γ length and the average length of prior austenite grains in the C direction is referred to as a C direction prior γ grain length, the ratio between the L direction priory γ grain length and the C direction priory grain length may be 0.03≤C direction priory γ grain length/L direction priory grain length ≤0.40.

[3] The hot rolled steel sheet according to [1] or [2] may further include, in the chemical composition, by mass %: one or two or more selected from the group consisting of Nb: 0.01% or more and 0.04% or less, Mo: 0.01% or more and 1.0% or less, Cu: 0.01% or more and 0.5% or less, and Ni: 0.01% or more and 0.5% or less.

[4] A method for manufacturing a hot rolled steel sheet according to another aspect of the present invention includes steps (a) to (d) of: (a) a heating step of heating a steel material having the chemical composition according to claim 1 to 1200° C. or higher and 1350° C. or lower, (b) a finish rolling step of performing rolling by continuously passing the steel material after being heated through a plurality of rolling stands, a finish rolling start temperature being set to 800° C. or higher, the rolling being performed so as to cause an A value defined by Formula (1) in each of the rolling stands to satisfy 0.05≤A≤23.0, an interpass time between the rolling stands being set to 0.2 seconds or longer and 10.0 seconds or shorter, a final rolling stand output side temperature being set to 800° C. or higher and 950° C. or lower, a cumulative rolling reduction in 800° C. or higher and 950° C. or lower being set to 70% or higher; (c) a cooling step of starting cooling within 10.0 seconds after the finish rolling and performing cooling at an average cooling rate equal to or higher than a martensite generation critical cooling rate V by ° C./s determined by Formulas (2) and (3); and (d) a winding step of performing winding at a winding temperature of 300° C. or lower after the cooling,

[Formula 2]

$$A = \frac{2\pi n}{60\sqrt{rH}} \ln\left(\frac{1}{1-r}\right) \quad (1)$$

$$V = 10^{2.94-0.75(\beta-1)} \quad (2)$$

$$\beta = 2.7 \times C + 0.4 \times Si + Mn + 0.45 \times Ni + Mo \quad (3)$$

where n in Formula (1) is a roll rotation speed by rpm, r is a rolling reduction by %, H is a rolling input side sheet thickness by mm, C, Si, Mn, Ni, and Mo in Formula (3) are amounts of the corresponding elements by mass %, and 0 mass % is substituted into terms Ni and Mo in a case where Ni and Mo are not contained.

Effects of the Invention

According to the above aspect of the present invention, it is possible to obtain a hot rolled steel sheet which is excellent in strength and toughness and also excellent in isotropy of the toughness and has a relatively low amount of alloy. According to the above aspect of the present invention, for example, it is possible to obtain a hot rolled steel sheet which has a ductile-brittle transition temperature of −60° C. or lower in both a direction (L direction) parallel to a rolling direction and a direction (C direction) parallel to a transverse direction and thus has high toughness. Therefore, when the hot rolled steel sheet according to the above aspect of the present invention is applied to structural components and frames of vehicles and truck frames, the weight of a vehicle body can be reduced while securing the safety of the vehicle, so that it becomes possible to reduce an environmental burden.

Moreover, according to the other aspect according to the present invention, a hot rolled steel sheet which has a strength as high as a tensile strength of 1180 MPa or more and is excellent in toughness and isotropy of the toughness can be stably manufactured, so that significant industrial effects can be exhibited.

EMBODIMENTS OF THE INVENTION

Hereinafter, a hot rolled steel sheet according to the present embodiment and a method for manufacturing the same will be described in detail.

First, the reasons for limiting the chemical composition of the hot rolled steel sheet according to the present embodiment (hereinafter sometimes simply referred to as a steel sheet) will be described. In addition, all % representing the following chemical composition mean mass %.

C: 0.06% or More and 0.20% or Less

C is an element necessary for obtaining the strength of the hot rolled steel sheet by improving the hardenability of steel and generating martensite which is a low temperature transformation phase. In order to obtain a desired strength, a C content of 0.06% or more is necessary. On the other hand, when the C content exceeds 0.20%, the workability and weldability of the steel sheet are deteriorated. Therefore, the C content is 0.06% or more and 0.20% or less. Preferably, the C content is 0.08% or more and 0.18% or less.

Si: 1.00% or Less

Si is an element that suppresses the generation of coarse oxides and cementite that deteriorate the toughness of the steel sheet and contributes to solid solution strengthening. However, when the Si content exceeds 1.00%, the surface properties of the steel sheet are significantly deteriorated, and the chemical convertibility and corrosion resistance thereof are lowered. Therefore, the Si content is set to 1.00% or less. From the viewpoint of suppressing the generation of coarse oxides and cementite and contributing to solid solution strengthening, the Si content is preferably 0.01% or more, and more preferably 0.40% or more. Furthermore, the Si content is preferably 0.80% or less.

Mn: More Than 1.5% and 3.5% or Less

Mn is an element that is dissolved in steel as a solid solution, contributes to improving the strength of the steel, and also enhances the hardenability. In order to obtain such an effect, the Mn content needs to be more than 1.5%. On the other hand, when the Mn content exceeds 3.5%, not only is the above effect saturated, but also a band-like structure is formed by solidifying segregation, and the workability and delayed fracture resistance properties of the steel sheet are lowered. Therefore, the Mn content is set to be more than 1.5% and 3.5% or less. The Mn content is 1.8% or more, preferably 2.0% or more, and preferably 3.0% or less.

P: 0.040% or Less

P is an element that is dissolved in steel as a solid solution and contributes to improving the strength of the steel. However, P is also an element that segregates at grain boundaries, particularly prior austenite grain boundaries, and causes a reduction in the low temperature toughness and workability of the steel sheet. For this reason, the P content is reduced as much as possible, and is preferably set to 0%, but a P content of up to 0.040% is acceptable. Therefore, the P content is set to 0.040% or less. However, even if the P content is excessively reduced, an effect commensurate with an increase in refining costs cannot be obtained. Therefore, the P content is preferably set to 0.003% or more and 0.005% or more. Furthermore, the P content is preferably set to 0.030% or less and 0.020% or less.

S: 0.004% or Less

S is an element that is bonded to Ti or Mn in steel to form coarse sulfides and lowers the workability of the hot rolled steel sheet. For this reason, the S content is preferably reduced as much as possible, and is preferably set to 0%, but a S content of up to 0.004% is acceptable. Therefore, the S content is set to 0.004% or less. However, even if the S content is excessively reduced, an effect commensurate with an increase in refining costs cannot be obtained. Therefore, the S content is preferably set to 0.0003% or more, 0.0005% or more, or 0.001% or more. The S content is preferably set to 0.003% or less and 0.002% or less.

Al: 0.10% or Less

Al is an element that acts as a deoxidizing agent in a steelmaking stage and is effective in improving the cleanliness of steel. However, when Al is excessively contained, an increase in oxide inclusions is incurred, which lowers the toughness of the hot rolled steel sheet causes the occurrence of flaws. Therefore, the Al content is set to 0.10% or less. The Al content is 0.005% or more, preferably 0.01% or more, and preferably 0.08% or less.

N: 0.004% or Less

N is an element that precipitates in steel as a nitride by being bonded to a nitride-forming element and contributes to the refinement of grains. Therefore, the N content is preferably set to 0.0005% or more. However, N is likely to be bonded to Ti at a high temperature and precipitate as coarse nitrides, and the coarse nitrides lower the toughness of the hot rolled steel sheet. For this reason, N content is set to 0.004% or less. The N content is more preferably 0.001% or more, and is preferably 0.003% or less.

Ti: 0.04% or More and 0.20% or Less

Ti refines grains by forming fine carbonitrides in steel and thus improves the strength and toughness of the hot rolled steel sheet. In order to exhibit such an effect, the Ti content needs to be 0.04% or more. On the other hand, when the Ti content exceeds 0.20%, the above effect is saturated, and a large amount of coarse precipitates are precipitated in steel, resulting in a reduction in the toughness of the hot rolled steel sheet. Therefore, the Ti content is set to 0.04% or more and 0.20% or less. The Ti content is 0.05% or more, preferably more than 0.05%, and preferably 0.10% or less.

The above are the base elements of the hot rolled steel sheet according to the present embodiment. However, the hot rolled steel sheet according to the present embodiment may contain one or two or more selected from the group consisting of Nb, Mo, Cu, and Ni as necessary for the purpose of further improving the toughness and increasing the strength. in a case where these elements are not contained, the lower limit of these elements is 0%.

Nb: 0% or More and 0.04% or Less

Nb is an element that improves the strength of steel by forming carbonitrides. In order to exhibit such an effect, the Nb content is preferably set to 0.01% or more. On the other hand, when the Nb content exceeds 0.04%, deformation resistance increases, so that there are cases where the rolling force of hot rolling during manufacturing increases, a burden on a rolling mill becomes too large, and a rolling operation itself is difficult to perform. When Nb content exceeds 0.04%, there are cases where coarse precipitates are formed in steel and the toughness of the hot rolled steel sheet decreases. Therefore, the Nb content is preferably set to 0.01% or more and 0.04% or less. The Nb content is more preferably 0.02% or more and 0.03% or less.

Mo: 0% or More and 1.0% or Less

Mo is an element that enhances the hardenability of steel and contributes to increasing the strength of the steel sheet. In order to obtain such an effect, the Mo content is preferably set to 0.01% or more. However, since Mo causes an expensive alloy cost, when a large amount of Mo is contained, the cost increases. In addition, when the Mo content exceeds 1.0%, there are cases where the weldability of the steel sheet decreases. Therefore, the Mo content is preferably set to 0.01% or more and 1.0% or less. The Mo content is more preferably 0.02% or more and 0.4% or less.

Cu: 0% or More and 0.5% or Less

Cu is an element that is dissolved in steel as a solid solution and improves the strength of the steel. Cu is also an element that improves hardenability. In order to obtain these effects, the Cu content is preferably set to 0.01% or more. However, when the Cu content exceeds 0.5%, there are cases where the surface properties of the hot rolled steel sheet are reduced, and chemical convertibility and corrosion resistance are reduced. Therefore, the Cu content is preferably set to 0.01% or more and 0.5% or less. The Cu content is more preferably 0.05% or more and 0.3% or less.

Ni: 0% or More and 0.5% or Less

Ni is dissolved in steel as a solid solution, contributes to increasing the strength of the steel, and also improves hardenability. In order to obtain these effects, the Ni content is preferably set to 0.01% or more. However, since Ni causes an expensive alloy cost, when a large amount of Ni is contained, the cost increases. In addition, when the Ni content exceeds 0.5%, there are cases where the weldability of the steel sheet decreases. Therefore, the Ni content is preferably set to 0.01% or more and 0.5% or less. The Ni content is more preferably 0.02% or more and 0.3% or less.

Elements other than the above-mentioned elements may be contained in the steel sheet in the range that does not hinder the effects of the present invention. That is, the remainder may be substantially iron. The steel sheet according to the present embodiment may contain 0.005% or less of each of Ca, REM, and the like for the purpose of improving delayed fracture resistance properties, for example. In addition, the steel sheet according to the present embodiment may contain a trace element that improves hot workability.

Next, the reason for limiting the metallographic structure of the hot rolled steel sheet according to the present embodiment will be described.

The metallographic structure of the hot rolled steel sheet according to the present embodiment contains martensite as a primary phase, and more preferably contains a single phase of martensite. In a case where one having an orientation difference of 5° or more from adjacent grains is defined as a grain, a metallographic structure in which the average length of grains in a direction (L direction) parallel to a rolling direction calculated by a section method is 0.2 μm or more and 5.0 μm or less, the average length of grains in a direction (C direction) parallel to a transverse direction is 0.1 μm or more and 5.0 μm or less, the ratio between the average length (L direction grain length) of the grains in the L direction and the average length (C direction grain length) of the grains in the C direction is 0.2≤C direction grain length/L direction grain length≤5.0 is provided.

In the hot rolled steel sheet according to the present embodiment, in a case where martensite is contained as a primary phase in the metallographic structure, a residual structure is further included. In a case where the metallographic structure is a single phase of martensite, the residual structure is not included.

In addition, "90 vol % or more of martensite" may include only 90 vol % or more of martensite, or may include 90 vol % or more of both martensite and tempered martensite in total. In the present embodiment, either form can secure excellent strength and isotropy of toughness, so that there is no need to distinguish between martensite and tempered martensite.

The tempered martensite is martensite that has been tempered and has a lower dislocation density than martensite. The manufacturing method according to the present embodiment, which will be described later, does not include a heating step for the purpose of tempering after rapid cooling. However, there are cases where tempered martensite is generated by reheating after hardening or winding.

In the present embodiment, the "primary phase" refers to a case where the phase is 90% or more in volume fraction. By causing the primary phase to be martensite, a desired high strength can be obtained. The residual structure other than the primary phase includes bainite and/or ferrite. When the volume fraction of the residual structure increases, the strength of the steel sheet decreases, and the desired strength cannot be obtained. For this reason, the volume fraction of the residual structure is set to 10% or less. The residual structure is preferably 5% or less, more preferably 1% or less.

In the present embodiment, "single phase" is a form of the "primary phase" and means that the volume fraction of the phase is 100%. The volume fraction of the residual structure in the case where the metallographic structure is a single phase of martensite is 0%.

For measurement of the metallographic structure, first, a test piece for scanning electron microscope observation is taken from a sheet thickness ¼ depth position and a sheet width center position of the hot rolled steel sheet so that a cross section parallel to the rolling direction and the transverse direction becomes an observed section. In the present embodiment, the sheet thickness ¼ depth position is a position advanced to a length of ¼ of the sheet thickness from the surface of the steel sheet in a normal direction. After the observed section is mirror-polished, the observed section is corroded with 3% nital solution, and three visual fields are photographed at a magnification of 2000-fold using a scanning electron microscope. Each measurement visual field is set to 500 μm×500 μm. Thereafter, image processing is performed, and the kind of metallographic structure and the area fraction of the metallographic structure are measured. Since the area fraction and the volume fraction are substantially the same, the obtained area fraction of each metallographic structure is defined as the volume fraction of the corresponding metallographic structure.

In the hot rolled steel sheet according to the present embodiment, in the metallographic structure at the sheet thickness ¼ depth position and the sheet width center position, the average length of grains in the direction (L direction) parallel to the rolling direction is 0.2 μm or more and 5.0 μm or less, the average length of grains in the direction (C direction) parallel to the transverse direction is 0.1 μm or more and 5.0 μm or less, and the ratio between the average length (L direction grain length) of the grains in the L direction and the average length (C direction grain length) of the grains in the C direction is 0.2≤C direction grain length/L direction grain length≤5.0. When the average length of the grains in the L direction and/or C direction exceeds 5.0 μm, the toughness in the L direction and/or C direction deteriorates. Furthermore, when the average length of the grains in the L direction is less than 0.2 μm or the average length of the grains in the C direction is less than 0.1 μm, the effect of improving toughness due to the refinement of the grains is saturated. On the other hand, when the ratio between the L direction grain length and the C direction grain length (C direction grain length/L direction grain length) exceeds 5.0 or is less than 0.2, the anisotropy of toughness increases, and excellent toughness is not obtained in both the L direction and the C direction. Therefore, the L direction grain length (average length) is 0.2 μm or more and 5.0 μm or less, the C direction grain length (average length) is 0.1 μm or more and 5.0 μm or less, and 0.2≤C direction grain length/L direction grain length ≤5.0 is satisfied.

For example, regarding the average length of the grains obtained by the section method, 100 to 150 line segments having a total length L are drawn in each of the L direction and the C direction on a photograph of a sample cross section, the number n of grains crossed by the line segments is obtained, L/n of each of the line segments drawn on the photograph is calculated, and the average value thereof is defined as the average length of the grains in each of the L direction and the C direction.

In the present embodiment, a test piece for backscattered electron diffraction (EBSP) is taken from the sheet thickness ¼ depth position of the hot rolled steel sheet and the sheet width center position so that cross sections parallel to the rolling direction and the transverse direction become observed sections. After polishing the observed section, the structure is revealed by electrolytic polishing, and three visual fields are photographed at a magnification of 8000-fold using a backscattered electron diffraction apparatus (EBSP apparatus). Each measurement visual field is set to 500 μm×500 μm. Thereafter, using EBSP measurement data analysis software, one having an orientation difference of 5° or more from adjacent grains is defined as one grain. Then, 100 to 150 line segments having a total length of 100 μm are drawn on the image in directions respectively parallel to the L direction and the C direction, Un is obtained from the number of grains crossed by each of the straight lines, and the average value thereof is used as the average length of the grains in each of the L direction and the C direction.

In the present embodiment, "parallel to the rolling direction" includes a range of ±5° with respect to the rolling direction. Similarly, "parallel to the transverse direction" includes a range of ±5° with respect to a direction parallel to the transverse direction.

In the hot rolled steel sheet according to the present embodiment, the factor of grain refinement in each of the L direction and the C direction is not clear, but is presumed as follows. By performing finish rolling with a very large cumulative rolling reduction, the prior austenite grains are stretched in the L direction (rolling direction), but the dislocation density introduced into the prior austenite grains increases. Therefore, when martensitic transformation occurs, in a group of laths oriented parallel, laths different in orientation are generated in a disordered manner, and the block sizes tend to be refined. As a result, it is considered that not only the block sizes in the C direction but also the block sizes in the L direction stretched by rolling are refined. Therefore, as an index indicating that dislocations are sufficiently introduced into the prior austenite grains, the aspect ratio of the prior austenite grains (the ratio between the L direction priory grain length, which is the average length of the prior austenite grains in the L direction and the C direction prior γ grain length, which is the average length of the prior austenite grains in the C direction) is adopted, and the aspect ratio preferably satisfies 0.03≤C direction prior γ grain length/L direction prior γ grain length ≤0.40. In a case where the ratio between the L direction prior γ grain length and the C direction priory γ grain length (C direction prior γ grain length/L direction prior γ grain length) exceeds 0.40, the accumulation of strain during manufacturing is insufficient, and there are cases where a desired structure cannot be obtained in the hot rolled steel sheet after the manufacturing. In a case where the ratio between the L direction prior γ grain length and the C direction prior γ grain length (C direction priory γ grain length/L direction prior γ grain length) is less than 0.03, martensitic transformation is impeded by the restraint of the prior austenite grains greatly stretched in the L direction. In addition, laths are generated in the prior austenite grains to cross the L direction, and it becomes difficult to generate fine martensite in the L direction. Furthermore, since the shape of the prior austenite grain boundaries becomes complex, there are cases where a desired structure cannot be obtained in the hot rolled steel sheet after the manufacturing.

The ratio between the L direction prior γ grain length, which is the average length of the prior austenite grains in the L direction, and the C direction priory γ grain length, which is the average length of the prior austenite grains in the C direction, is measured by the following method.

Two optical microscope test pieces are taken from the sheet thickness ¼ depth position and the sheet width center position of the hot rolled steel sheet so that each of a cross section (L-section) perpendicular to the transverse direction and a cross section (C-section) perpendicular to the rolling direction becomes an observed section. After both the sample for L-section observation and the sample for C-section observation are mirror-polished, the observed sections are corroded with a Nital solution, and a visual field of 500 μm in the normal direction and 2000 μm in a direction perpendicular to the normal direction is photographed using an optical microscope. The average length of the prior austenite grains in the L direction (L direction priory γ grain length) is measured from the photograph of the sample for L-section observation, and the average length of the prior austenite grains in the C direction (C direction prior γ grain length) is measured from the photograph of the sample for C-section observation. Here, the L direction prior γ grain length and the C direction prior γ grain length are measured by measuring and averaging 100 grains in each of the photographs. For easy observation of the grains, in measurement of each of the cross sections, four adjacent visual fields of 500 μm×500 μm may be measured, and by connecting the visual fields, a visual field of 500 μm×2000 μm may be observed.

The hot rolled steel sheet according to the present embodiment has the above chemical composition and the metallographic structure. When the tensile strength is 1180

MPa or more, in a case where the hot rolled steel sheet according to the present embodiment is applied to structural components and frames of vehicles and truck frames, the sheet thickness can be reduced while secured a desired strength, and this can contribute to improving the fuel efficiency of vehicles.

In addition, the sheet thickness of the hot rolled steel sheet according to the present embodiment is not particularly limited, but may be 1.0 mm or more and 3.6 mm or less as a structural steel sheet of a vehicle.

Next, a method for manufacturing the hot rolled steel sheet according to the present embodiment will be described.

The method for manufacturing the hot rolled steel sheet according to the present embodiment includes a heating step (a) of heating a steel material having the above-described chemical composition, a finish rolling step (b) of performing finish rolling on the heated steel material, a cooling step (c) of performing cooling at an average cooling rate equal to or more than a martensite generation critical cooling rate V (° C./s) after the finish rolling, and a winding step (d) of performing winding at a winding temperature of 300° C. or lower after the cooling. In addition, a rough rolling step may be included between the heating step (a) and the finish rolling step (b). Hereinafter, the method for manufacturing the hot rolled steel sheet according to the present embodiment will be described in detail.

(A) Heating Step

In the heating step, the steel material having the above-described chemical composition is heated to 1200° C. or higher and 1350° C. or lower. A method for manufacturing the steel material is not particularly limited, and a conventional method can be applied in which molten steel having the above-described chemical composition is melted in a converter or the like and is cast into a steel material such as a slab by a casting method such as continuous casting. Alternatively, an ingot-making and blooming method may be used.

In a steel material such as a slab, most of carbonitride-forming elements such as Ti are present as coarse carbonitrides in a non-uniform distribution in the steel material. Coarse precipitates (carbonitrides) present in the non-uniform distribution deteriorate various properties (for example, tensile strength, toughness, and hole expansibility) of the hot rolled steel sheet. For this reason, the steel material before hot rolling is heated to dissolve coarse precipitates as a solid solution. In order to sufficiently dissolve the coarse precipitates as a solid solution before hot rolling, the heating temperature of the steel material needs to be 1200° C. or higher. However, when the heating temperature of the steel material becomes too high, surface flaws are generated and a reduction in yield due to scale-off is incurred. Therefore, the heating temperature of the steel material is 1350° C. or lower.

Although the steel material is heated to a heating temperature of 1200° C. or higher and retained for a predetermined time, when the retention time exceeds 4800 seconds, the amount of scale generated increases. As a result, scale biting and the like easily occur in the subsequent finish rolling step, and there are cases where the surface quality of the hot rolled steel sheet are deteriorated. Therefore, the retention time of the steel material in a temperature range of 1200° C. or higher is preferably set to 4800 seconds or shorter.

Rough Rolling Step

Rough rolling may be performed on the steel material between the heating step and the finish rolling step. The rough rolling may be performed to obtain desired sheet bar dimensions, and the conditions thereof are not particularly limited.

(b) Finish Rolling Step

Finish rolling is performed on the steel material heated in the heating step or the steel material after the rough rolling. Descaling is preferably performed before the finish rolling or in the middle of rolling between rolling stands of the finish rolling.

In the finish rolling step, the steel material after heating or rough rolling is continuously passed through a plurality of rolling stands for rolling. In the finish rolling step, rolling is performed at a cumulative rolling reduction of 70% or more in a temperature range of 800° C. or higher and 950° C. or lower. A final rolling stand output side temperature is set to 800° C. or higher and 950° C. or lower. Moreover, in each of the rolling stands, rolling is performed so that an A value defined by Formula (1) satisfies $0.05 \leq A \leq 23.0$. Furthermore, the pass time between the rolling stands is set to 0.2 seconds or longer and 10.0 seconds or shorter. In Formula (1), n is the roll rotation speed (rpm) in each of the rolling stands, r is the rolling reduction (%) in each of the rolling stands, and H is the rolling input side sheet thickness (mm) in each of the rolling stands. Hereinafter, the reasons for limiting the finish rolling step will be described.

[Formula 3]

$$A = \frac{2\pi n}{60\sqrt{rH}} \ln\left(\frac{1}{1-r}\right) \tag{1}$$

(Finish Rolling Start Temperature: 800° C. or Higher)

In the finish rolling, the steel material after the heating is continuously passed through the plurality of rolling stands and rolled, and the start temperature of the finish rolling is set to 800° C. or higher. When the finish rolling start temperature is lower than 800° C., rolling in some of the plurality of rolling stands (particularly the first half rolling stands) is performed at a ferrite+austenite dual phase region temperature, and the worked structure remains after the finish rolling, resulting in a reduction in the strength and toughness of the hot rolled steel sheet. Therefore, the finish rolling start temperature is set to 800° C. or higher. The finish rolling start temperature is the entrance temperature of the rolling stand through which the steel sheet first passes and the surface temperature of the steel sheet. By setting the finish rolling start temperature to be 800° C. or higher and setting the final rolling stand output side temperature to 800° C. or higher and 950° C. or lower as described below, rolling is performed in a temperature range of 800° C. or higher in all the rolling stands. The upper limit of the finish rolling start temperature may be 1100° C. in order to suppress coarsening of austenite.

(Final Rolling Stand Output Side Temperature: 800° C. or Higher and 950° C. or Lower)

When the final rolling stand output side temperature, which is a finish rolling finishing temperature, is lower than 800° C., the rolling is performed at a ferrite+austenite dual phase region temperature, the worked structure remains after the finish rolling, resulting in a reduction in the strength and toughness of the hot rolled steel sheet. On the other hand, in the steel material having the chemical composition according to the present embodiment, a non-recrystallization austenite region is a temperature range of approximately 950° C. or lower. Therefore, when the final rolling stand output side temperature exceeds 950° C., austenite grains grow and the grain length of martensite of the hot rolled steel sheet obtained after the cooling increases. As a result, it becomes difficult to obtain a desired structure, and the strength and toughness of the hot rolled steel sheet are reduced. Therefore, the final rolling stand output side temperature is set to 800° C. or higher and 950° C. or lower. In addition, the temperature mentioned here represents the surface temperature of the steel sheet.

(Cumulative Rolling Reduction in 800° C. or Higher and 950° C. or Lower: 70% or Higher)

As described above, in the steel material having the chemical composition according to the present embodiment, the non-recrystallization austenite region is a temperature range of approximately 950° C. or lower, so that the final rolling stand output side temperature is set to 950° C. or lower. In a case where the cumulative rolling reduction of the finish rolling in the temperature range (800° C. or higher and 950° C. or lower) from the finish rolling start temperature to the final rolling stand output side temperature is less than 70%, the dislocation density introduced into non-recrystallization austenite becomes small. When the dislocation density introduced into the non-recrystallization austenite becomes small, it becomes difficult to obtain a desired structure, and the strength and toughness of the hot rolled steel sheet are reduced. Therefore, the cumulative rolling reduction in 800° C. or higher and 950° C. or lower by the plurality of rolling stands in the finish rolling is set to 70% or more. However, when the cumulative rolling reduction in 800° C. or higher and 950° C. or lower exceeds 97%, there are cases where the shape of the steel sheet is deteriorated. Therefore, the cumulative rolling reduction in the above temperature range is desirably set to 97% or lower.

In the present embodiment, the cumulative rolling reduction in 800° C. or higher and 950° C. or lower is the percentage of the total rolling reduction amount in this temperature range (the difference between the inlet sheet thickness before the initial pass in rolling in this temperature range and the outlet sheet thickness after the final pass in rolling in this temperature range).

(Interpass Time between Rolling Stands: 0.2 Seconds or Longer and 10.0 Seconds or Shorter)

In the finish rolling step, rolling is performed by continuously passing the steel material after being heated through the plurality of rolling stands. When the interpass time between the rolling stands exceeds 10.0 seconds, recovery and recrystallization between passes progress, accumulation of strain becomes difficult, and a desired structure cannot be obtained. Although it is preferable that the interpass time is short, the shortening of the interpass time is limited in terms of the installation space of the rolling stands and the rolling speed. Therefore, the interpass time is set to 0.2 seconds or longer.

(A value in Each of Rolling Stands: $0.05 \leq A \leq 23.0$)

The A value defined by Formula (1) is a value calculated based on rolling conditions, and can thus represent the magnitude relationship of the dislocation density. As the A value increases, the dislocation density introduced into austenite also increases. However, when the A value exceeds 23.0, the deformation heating amount becomes significant, the temperature of the steel piece increases, so that accumulation of strain becomes difficult even if the interpass time between the rolling stands is 0.2 seconds or longer and 10.0 seconds or shorter. On the other hand, when the A value is less than 0.05, the dislocation density introduced into austenite decreases even if the interpass time between the rolling stands is 0.2 seconds or longer and 10.0 seconds or shorter. As a result, it becomes difficult to obtain a desired structure, and the strength and toughness of the hot rolled steel sheet are reduced. Therefore, it is desirable to perform rolling so that the interpass time between the rolling stands of the finish rolling is 0.2 seconds or longer and 10.0 seconds or shorter, and $0.05 \leq A \leq 23.0$ is satisfied in each of the rolling stands. A more preferable range of the A value is 0.20 or more and 20.0 or less. It is more preferable that the A value in the final stand is set to 10.0 or more.

(c) Cooling Step

In the cooling step, cooling is started within 10.0 seconds after completion of the finish rolling, and cooling is performed at an average cooling rate equal to or more than the martensite generation critical cooling rate V (° C./s).

In the present embodiment, a cooling facility is installed at the rear stage of a finish rolling facility, and cooling is performed while passing the steel sheet after being subjected to the finish rolling through the cooling facility. The cooling facility is preferably a facility capable of cooling the steel sheet at an average cooling rate equal to or more than the martensite generation critical cooling rate V (° C./s). As such a cooling facility, for example, a water cooling facility using water as a cooling medium is an exemplary example.

The average cooling rate in the cooling step is set to a value obtained by dividing a temperature drop width of the steel sheet from the start of the cooling to the end of the cooling by a time taken from the start of the cooling to the end of the cooling. The start of the cooling is when the steel sheet is introduced into the cooling facility, and the end of the cooling is when the steel sheet is led out from the cooling facility.

In addition, the cooling facility includes a facility having no air cooling section in the middle and a facility having one or more air cooling sections in the middle. In the present embodiment, any cooling facility may be used. Even in a case where a cooling facility having an air cooling section is used, the average cooling rate from the start of the cooling to the end of the cooling may be equal to or more than the martensite generation critical cooling rate V (° C./s).

Hereinafter, the reasons for limiting the cooling conditions will be described. The cooling stop temperature is 300° C. or less, and this condition will be described in the winding step.

(Cooling Start Time: within 10.0 Seconds after Finish Rolling)

Cooling is started immediately after the finish rolling. More specifically, cooling is started within 10.0 seconds after the finish rolling, more preferably within 5.0 seconds, and even more preferably within 1.0 seconds. When the cooling start time is delayed, recrystallization proceeds and cooling is performed in a state where the strain is released, so that a desired structure cannot be obtained.

(Average Cooling Rate: Equal To or More Than Martensite Generation Critical Cooling Rate V (° C./s))

The average cooling rate is set to be equal to or more than the martensite generation critical cooling rate V (° C./s). When cooling is performed at an average cooling rate lower than the martensite generation critical cooling rate V (° C./s), bainite and ferrite are easily formed, and the volume fraction of martensite is reduced. The martensite generation critical cooling rate V (° C./s) in the present embodiment is the minimum cooling rate at which the martensite fraction of the metallographic structure after the cooling becomes 90% or more. Specifically, the martensite generation critical cooling rate V (° C./s) in the present embodiment is calculated by Formulas (2) and (3). However, element symbols in Formula (3) are the amounts (mass %) of the corresponding elements.

In a case where Ni and Mo are not contained, 0 mass % is substituted into the terms Ni and Mo. Cooling at a martensite generation critical cooling rate V (° C./s) or more is preferably performed until the cooling stop temperature is reached.

$$V=10^{2.94-0.75(\beta-1)} \quad (2)$$

$$\beta=2.7\times C+0.4\times Si+Mn+0.45\times Ni+Mo \quad (3)$$

(d) Winding Step

The steel sheet cooled to the cooling stop temperature in the cooling step is wound at 300° C. or lower. Since the steel sheet is wound immediately after the cooling, the winding temperature is substantially equal to the cooling stop temperature. When the winding temperature exceeds 300° C., polygonal ferrite or bainite is generated, resulting in a decrease in strength. Therefore, the winding temperature that is the cooling stop temperature is set to 300° C. or less.

In addition, after the winding, the hot rolled steel sheet may be subjected to temper rolling according to a conventional method, or may be pickled to remove scale formed on the surface thereof. Alternatively, a coating treatment such as hot-dip galvanizing and electrogalvanizing, and a chemical conversion treatment may be performed.

EXAMPLES

Molten steel having the chemical composition shown in Table 1 was melted in a converter and cast into a slab (steel material) by a continuous casting method. "Critical cooling rate (° C./s)" in Tables 1, 2A, and 2B is the martensite generation critical cooling rate V (° C./s), and is calculated by Formulas (2) and (3). However, element symbols in Formula (3) are the amounts (mass %) of the corresponding elements. In a case where Ni and Mo were not contained, 0 mass % was substituted into the terms Ni and Mo.

$$V=10^{2.94-0.75(\beta-1)} \quad (2)$$

$$\beta=2.7\times C+0.4\times Si+Mn+0.45\times Ni+Mo \quad (3)$$

Next, these steel materials were heated under the conditions shown in Tables 2A and 2B, subjected to rough rolling, and thereafter subjected to finish rolling (a total of 7 passes, rolling stands F1 to F7) under the conditions shown in Tables 2A and 2B. A finish rolling start temperature was set to 800° C. or higher for all the steel materials. After finishing the finish rolling, cooling was performed under the conditions shown in Tables 2A and 2B, cooling to the winding temperature shown in Tables 2A and 2B was performed, and winding was performed, whereby hot rolled steel sheets having the thicknesses shown in Tables 2A and 2B were obtained.

The cumulative rolling reduction in Tables 2A and 2B represents the cumulative rolling reduction in 800° C. or higher and 950° C. or lower in the rolling stands F1 to F7 of the finish rolling. In addition, "A" is the A value in each of the paths calculated by Formula (1), and "P/s" is the interpass time (seconds). For example, "P/s" described in F1 column represents the interpass time between the rolling stand F1 and the rolling stand F2.

Cooling after the finish rolling was performed by water cooling, and was performed by passing the steel sheet through a water cooling facility having no air cooling section in the middle. The cooling rate in Tables 2A and 2B is an average cooling rate obtained by dividing the temperature drop width of the steel sheet from the time of introduction into the water cooling facility to the time of extraction from the water cooling facility by the passing time of the steel sheet through the water cooling facility.

Test pieces were taken from the obtained hot rolled steel sheets and subjected to structure observation, tension test, and Charpy impact test. The results of each of the tests are shown in Tables 2C and 2D. In metallographic structure column in Tables 2C and 2D, the M phase represents the volume fraction of martensite, and the residual structure represents the volume fraction of bainite, ferrite, or both. A structure observation method and various test methods were as follows.

Structure Observation: Volume Fraction of Metallographic Structure

Scanning electron microscope test pieces were taken from a sheet thickness ¼ depth position and a sheet width center position of the hot rolled steel sheet so that cross sections parallel to the rolling direction and the transverse direction becomes observed sections. The observed section was mirror-polished, corroded with 3% Nital solution, and three visual fields are photographed at a magnification of 2000-fold using a scanning electron microscope. The measurement visual field was 500 μm×500 μm. Thereafter, image processing was performed, and the kind of metallographic structure, each phase, and the area fraction of the metallographic structure were measured. The obtained area fraction of each metallographic structure was defined as the volume fraction of each structure.

Structure Observation: Average Length of Grains (L Direction Grain Length and C Direction Grain Length)

Test pieces for backscattered electron diffraction (EBSP) were taken from the sheet thickness ¼ depth position and the sheet width center position of the hot rolled steel sheet so that the cross sections parallel to the rolling direction and the transverse direction became observed sections. After polishing the observed section, the structure was revealed by electrolytic polishing, and three visual fields were photographed at a magnification of 8000-fold using a backscattered electron diffraction apparatus (EBSP apparatus). The measurement visual field was 500 μm×500 μm. Thereafter, using EBSP measurement data analysis software, by defining one having an orientation difference of 5° or more from adjacent grains as one grain, grain lengths were obtained by a section method.

In the section method, 133 line segments with a total length of 100 μm were drawn on an image in directions respectively parallel to an L direction and a C direction, L/n was obtained from the number of grains crossed by each of the straight lines, and the average value thereof was used as the average length of the grains in each of the L direction and the C direction.

The ratio of the L direction prior γ grain length, which is the average length of the prior austenite grains in the L direction, and the C direction prior γ grain length, which is the average length of the prior austenite grains in the C direction, was measured by the following method.

First, two optical microscope test pieces were taken from the sheet thickness ¼ depth position and the sheet width center position of the hot rolled steel sheet so that each of the cross section (L-section) perpendicular to the transverse direction and the cross section (C-section) perpendicular to the rolling direction became an observed section. After both the sample for L-section observation and the sample for C-section observation were mirror-polished, the observed sections were corroded with a nital solution, and a visual field of 500 μm in the normal direction and 2000 μm in a direction perpendicular to the normal direction was photographed using an optical microscope. The average length of the prior austenite grains in the L direction (L direction priory grain length) was measured from the photograph of the sample for L-section observation, and the average length of the prior austenite grains in the C direction (C direction priory γ grain length) was measured from the photograph of the sample for C-section observation. Here, the L direction prior γ grain length and the C direction prior γ grain length were measured by measuring and averaging 100 grains in each of the photographs. In each of the cross sections, four adjacent visual fields of 500 μm×500 μm were measured, and by connecting the visual fields, a visual field of 500 μm×2000 μm was observed.

Tension Test

A JIS No. 5 test piece was taken from the hot rolled steel sheet so that a tensile direction is parallel to the rolling direction, a tension test was conducted according to JIS Z 2241:2011, and a tensile strength (TS) was obtained.

A case where the tensile strength was 1180 MPa or more was determined to be acceptable as having the strength desired in the present invention. A case where the tensile strength was less than 1180 MPa was determined to be unacceptable as not having the strength desired in the present invention.

Charpy Impact Test

A sub-size test piece (V notch) having a thickness of 2.5 mm was taken from the hot rolled steel sheet so that the longitudinal direction of the test piece was a direction (L direction) parallel to the rolling direction and a direction (C direction) parallel to the transverse direction, a Charpy impact test was conducted from room temperature to −198° C. according to JIS Z 2242: 2005, and a ductile-brittle transition temperature (DBTT) in each of the L direction and the C direction was obtained. Here, as for the sheet thickness of the test piece, the test piece was prepared to have a sheet thickness of 2.5 mm by grinding both sides of the hot rolled steel sheet. In Tables 2C and 2D, the ductile-brittle transition temperatures in the L direction and the C direction are respectively indicated by "transition temperature (L)" and "transition temperature (C)".

A case where the ductile-brittle transition temperature in the L direction and the C direction was −60° C. or lower was determined that toughness and isotropy of the toughness isotropic were excellent.

TABLE 1

| Steel | Chemical composition (mass %) remainder consisting of Fe and impurities | | | | | | | | | | | | Critical cooling rate | |
|---|---|---|---|---|---|---|---|---|---|---|---|---|---|---|
| No | C | Si | Mn | P | S | Al | N | Ti | Nb | Mo | Cu | Ni | ° C./s | Note |
| A | 0.08 | 0.90 | 1.8 | 0.004 | 0.003 | 0.05 | 0.004 | 0.10 | | | | | 81 | Invention steel |
| B | 0.08 | 0.01 | 2.5 | 0.003 | 0.003 | 0.04 | 0.004 | 0.10 | | | | | 45 | Invention steel |
| C | 0.13 | 0.05 | 1.8 | 0.003 | 0.002 | 0.09 | 0.004 | 0.08 | | | 0.1 | | 115 | Invention steel |
| D | 0.06 | 0.40 | 2.8 | 0.002 | 0.002 | 0.03 | 0.004 | 0.20 | 0.02 | | | | 22 | Invention steel |
| E | 0.14 | 0.60 | 2.0 | 0.010 | 0.003 | 0.10 | 0.004 | 0.10 | | 0.03 | | | 51 | Invention steel |
| F | 0.18 | 0.80 | 1.6 | 0.024 | 0.001 | 0.03 | 0.003 | 0.05 | | | | | 77 | Invention steel |
| G | 0.20 | 0.10 | 1.6 | 0.008 | 0.003 | 0.03 | 0.003 | 0.08 | | | | 0.02 | 112 | Invention steel |
| H | 0.04 | 0.20 | 1.5 | 0.004 | 0.003 | 0.05 | 0.004 | 0.04 | 0.03 | | | | 265 | Comparative steel |
| I | 0.10 | 0.40 | 1.9 | 0.010 | 0.003 | 0.04 | 0.004 | 0.25 | | | | | 88 | Comparative steel |

Underline indicates outside of the range of the present invention.

Blank means that the corresponding element is not actively contained.

TABLE 2A

| Test | Steel | Finish rolling | | | | | | | | | | | | | | | | Cooling | | | | |
|---|---|---|---|---|---|---|---|---|---|---|---|---|---|---|---|---|---|---|---|---|---|---|
| | | Heating temperature | Final rolling stand output side temperature | Cumulative rolling reduction | F1 | | F2 | | F3 | | F4 | | F5 | | F6 | | F7 | Time from finish rolling to start of cooling | Cooling rate | Critical cooling rate | Winding temperature | Sheet thickness |
| No. | No. | ° C. | ° C. | % | A | P/s | A | P/s | A | P/s | A | P/s | A | P/s | A | P/s | A | t | ° C./s | s | ° C. | mm |
| 1 | A | 1200 | 898 | 87 | 0.25 | 6.0 | 0.71 | 5.9 | 1.9 | 3.6 | 3.3 | 1.7 | 6.4 | 1.1 | 9.4 | 0.8 | 12.1 | 0.5 | 234 | 81 | 105 | 2.7 |
| 2 | A | 1200 | 875 | 82 | 0.24 | 8.0 | 0.69 | 7.0 | 2.0 | 4.6 | 3.7 | 1.8 | 5.4 | 1.7 | 7.2 | 0.2 | 11.3 | 0.2 | 125 | | 80 | 2.9 |
| 3 | A | 1250 | 865 | 74 | 0.11 | 9.0 | 0.77 | 5.7 | 1.9 | 3.0 | 4.2 | 2.6 | 5.3 | 1.6 | 7.5 | 1.0 | 10.7 | 3.1 | 153 | | 254 | 3.5 |
| 4 | A | 1250 | 854 | 76 | 0.13 | 10.0 | 0.78 | 5.3 | 1.8 | 4.2 | 3.7 | 2.9 | 7.2 | 1.8 | 9.8 | 1.0 | 17.1 | 1.1 | 185 | | 102 | 3.1 |
| 5 | A | 1300 | 830 | 86 | 0.30 | 6.0 | 0.72 | 7.0 | 1.4 | 3.1 | 2.7 | 2.6 | 5.1 | 1.8 | 6.2 | 1.2 | 11.7 | 1.2 | 146 | | 170 | 3.3 |
| 6 | B | 1200 | 980 | 0 | 0.22 | 9.0 | 0.70 | 6.5 | 1.7 | 3.5 | 3.9 | 2.8 | 5.6 | 1.0 | 6.3 | 0.7 | 12.1 | 0.7 | 233 | 45 | 33 | 2.7 |
| 7 | B | 1250 | 896 | 96 | 0.27 | 6.0 | 0.59 | 6.6 | 1.4 | 4.3 | 3.7 | 3.0 | 6.7 | 1.1 | 6.1 | 0.8 | 14.8 | 1.7 | 225 | | 251 | 3.2 |
| 8 | B | 1200 | 931 | 78 | 0.06 | 10.0 | 0.63 | 6.1 | 1.3 | 3.7 | 4.0 | 2.7 | 6.8 | 1.8 | 7.1 | 1.1 | 9.2 | 1.1 | 247 | | 208 | 2.8 |
| 9 | B | 1300 | 893 | 71 | 0.25 | 8.0 | 0.58 | 6.2 | 1.8 | 3.6 | 4.2 | 2.7 | 6.3 | 2.3 | 6.9 | 1.8 | 14.1 | 2.1 | 189 | | 93 | 2.7 |
| 10 | C | 1200 | 944 | 94 | 0.22 | 10.0 | 0.86 | 6.9 | 1.5 | 3.9 | 3.4 | 2.3 | 6.7 | 1.5 | 10.9 | 1.0 | 11.8 | 0.9 | 222 | 115 | 188 | 2.7 |
| 11 | C | 1250 | 886 | 85 | 0.15 | 9.0 | 0.90 | 4.8 | 2.0 | 4.5 | 3.7 | 2.3 | 6.8 | 1.1 | 9.9 | 0.5 | 13.2 | 5.5 | 141 | | 109 | 3.0 |

TABLE 2A-continued

| | | Finish rolling | | | | | | | | | | | | | | | | Cooling | | | | |
|---|---|---|---|---|---|---|---|---|---|---|---|---|---|---|---|---|---|---|---|---|---|---|
| Test | Steel | Heating temperature | Final rolling stand output side temperature | Cumulative rolling reduction | F1 | | F2 | | F3 | | F4 | | F5 | | F6 | | F7 | Time from finish rolling to start of cooling | Cooling rate | Critical cooling rate | Winding temperature | Sheet thickness |
| No. | No. | ° C. | ° C. | % | A | P/s | A | P/s | A | P/s | A | P/s | A | P/s | A | P/s | A | t | ° C./s | s | ° C. | mm |
| 12 | C | 1200 | 920 | 75 | 0.24 | 7.0 | 0.71 | 4.7 | 1.4 | 3.8 | 3.6 | 1.6 | 5.7 | 2.1 | 13.4 | 1.7 | 22.5 | 1.5 | 163 | | 141 | 2.9 |
| 13 | C | 1200 | 900 | 70 | 0.18 | 12.0 | 0.66 | 4.5 | 1.4 | 3.2 | 3.1 | 1.8 | 5.2 | 1.2 | 16.0 | 0.5 | 21.2 | 1.5 | 151 | | 50 | 2.9 |
| 14 | C | 1250 | 910 | 79 | 0.19 | 8.0 | 0.81 | 5.4 | 1.8 | 4.6 | 4.1 | 3.0 | 6.2 | 1.6 | 8.4 | 0.6 | 12.4 | 0.5 | 161 | | 82 | 3.0 |
| 15 | C | 1250 | 809 | 96 | 0.21 | 9.0 | 0.67 | 6.0 | 1.4 | 3.2 | 3.5 | 2.1 | 5.1 | 3.0 | 6.4 | 1.9 | 14.3 | 1.8 | 131 | | 81 | 2.9 |

Underline indicates outside of the range of the present invention or outside of the range of a preferable characteristic value.

TABLE 2B

| Test | Steel | Heating temperature | Finish rolling: Final rolling stand output side temperature | Finish rolling: Cumulative rolling reduction | Finish rolling: F1 | | Finish rolling: F2 | | Finish rolling: F3 | | Finish rolling: F4 | | Finish rolling: F5 | | Finish rolling: F6 | | Finish rolling: F7 | | Cooling: Time from finish rolling to start of cooling | Cooling: Cooling rate | Cooling: Critical cooling rate | Winding temperature | Sheet thickness |
|---|---|---|---|---|---|---|---|---|---|---|---|---|---|---|---|---|---|---|---|---|---|---|---|
| No. | No. | ° C. | ° C. | % | A | P/s | A | P/s | A | P/s | A | P/s | A | P/s | A | P/s | A | | t | ° C./s | ° C./s | ° C. | mm |
| 16 | D | 1200 | 945 | 61 | 0.27 | 9.0 | 0.74 | 6.1 | 1.4 | 3.5 | 3.4 | 2.9 | 5.8 | 1.5 | 7.9 | 1.2 | 14.4 | | 1.1 | 225 | 22 | 280 | 2.7 |
| 17 | D | 1200 | 826 | 97 | 0.22 | 10.0 | 0.66 | 5.6 | 1.9 | 3.8 | 4.3 | 2.2 | 6.5 | 1.9 | 10.9 | 0.5 | 15.1 | | 0.6 | 133 | | 242 | 3.4 |
| 18 | D | 1200 | 814 | 93 | 0.04 | 8.0 | 0.49 | 5.4 | 1.6 | 4.8 | 3.9 | 2.3 | 5.4 | 1.7 | 14.1 | 1.3 | 21.4 | | 4.3 | 181 | | 64 | 3.2 |
| 19 | D | 1200 | 949 | 72 | 0.21 | 9.0 | 0.61 | 5.1 | 1.5 | 4.4 | 4.4 | 2.5 | 5.6 | 1.6 | 9.1 | 1.4 | 18.9 | | 1.4 | 242 | | 111 | 3.3 |
| 20 | D | 1200 | 893 | 78 | 0.70 | 6.0 | 2.10 | 3.0 | 4.3 | 2.0 | 8.2 | 1.4 | 12.0 | 1.2 | 16.2 | 1.0 | 19.0 | | 12.0 | 170 | | 80 | 2.3 |
| 21 | E | 1300 | 804 | 84 | 0.18 | 10.0 | 0.73 | 6.6 | 1.9 | 3.3 | 3.6 | 2.1 | 6.5 | 1.3 | 9.5 | 1.2 | 17.6 | | 1.4 | 229 | 51 | 142 | 3.3 |
| 22 | E | 1250 | 904 | 74 | 0.15 | 10.0 | 0.74 | 6.5 | 1.8 | 4.1 | 3.7 | 2.7 | 5.9 | 1.8 | 6.1 | 1.7 | 9.3 | | 1.8 | 145 | | 150 | 2.8 |
| 23 | E | 1250 | 915 | 79 | 0.28 | 11.0 | 2.20 | 2.1 | 3.2 | 1.6 | 4.8 | 1.3 | 8.1 | 0.9 | 9.3 | 0.8 | 11.2 | | 1.8 | 138 | | 100 | 2.8 |
| 24 | E | 1250 | 874 | 76 | 0.19 | 7.0 | 0.84 | 5.1 | 1.6 | 4.7 | 3.5 | 1.9 | 6.0 | 1.9 | 6.3 | 0.7 | 9.7 | | 0.7 | 122 | | 229 | 3.1 |
| 25 | E | 1250 | 865 | 95 | 0.16 | 8.0 | 0.59 | 5.6 | 2.0 | 4.3 | 3.1 | 2.9 | 5.6 | 1.4 | 6.9 | 1.8 | 17.1 | | 1.9 | 236 | | 272 | 2.9 |
| 26 | F | 1200 | 881 | 72 | 0.21 | 6.0 | 0.75 | 4.7 | 1.9 | 4.1 | 4.4 | 2.3 | 6.8 | 1.8 | 6.8 | 1.5 | 14.9 | | 7.2 | 135 | 77 | 174 | 2.8 |
| 27 | F | 1200 | 899 | 78 | 0.22 | 7.0 | 0.73 | 6.1 | 1.6 | 4.7 | 4.5 | 2.0 | 5.8 | 1.5 | 7.7 | 1.8 | 13.2 | | 1.4 | 177 | | 382 | 3.1 |
| 28 | F | 1250 | 833 | 83 | 0.26 | 8.0 | 0.76 | 6.6 | 1.9 | 4.1 | 3.6 | 1.9 | 8.1 | 1.0 | 10.6 | 0.8 | 11.8 | | 1.0 | 235 | | 88 | 2.8 |
| 29 | F | 1300 | 876 | 70 | 0.10 | 10.0 | 0.58 | 5.2 | 1.6 | 4.3 | 4.0 | 3.0 | 5.7 | 1.6 | 11.0 | 1.7 | 12.8 | | 1.7 | 171 | | 249 | 3.4 |
| 30 | G | 1300 | 816 | 84 | 0.25 | 7.0 | 0.78 | 5.3 | 1.7 | 4.7 | 4.0 | 1.9 | 6.4 | 1.3 | 7.7 | 0.9 | 17.8 | | 6.8 | 121 | 112 | 139 | 3.2 |
| 31 | G | 1200 | 972 | 73 | 0.25 | 7.0 | 0.67 | 4.9 | 1.5 | 3.1 | 4.4 | 2.2 | 6.1 | 1.0 | 13.3 | 0.8 | 23.7 | | 0.6 | 236 | | 114 | 3.5 |
| 32 | G | 1200 | 920 | 82 | 0.15 | 9.0 | 0.78 | 6.7 | 2.0 | 3.0 | 3.6 | 2.4 | 6.0 | 1.4 | 6.2 | 0.3 | 9.1 | | 0.4 | 211 | | 152 | 3.0 |
| 33 | G | 1200 | 843 | 84 | 0.25 | 9.0 | 0.82 | 4.6 | 1.5 | 3.6 | 4.4 | 2.9 | 5.9 | 1.9 | 6.4 | 1.2 | 16.9 | | 1.2 | 129 | | 54 | 3.3 |
| 34 | G | 1250 | 888 | 81 | 0.24 | 8.0 | 0.67 | 5.9 | 1.8 | 3.9 | 3.4 | 2.0 | 6.1 | 1.2 | 11.0 | 1.0 | 13.6 | | 0.9 | 250 | | 289 | 2.9 |
| 35 | H | 1200 | 856 | 71 | 0.25 | 9.0 | 0.81 | 6.3 | 2.0 | 4.7 | 3.7 | 2.9 | 6.5 | 1.3 | 7.9 | 1.1 | 10.3 | | 4.1 | 294 | 265 | 38 | 3.1 |
| 36 | I | 1250 | 908 | 97 | 0.22 | 7.0 | 0.90 | 5.8 | 1.9 | 3.1 | 3.3 | 2.1 | 6.9 | 1.5 | 9.5 | 1.2 | 17.5 | | 1.2 | 145 | 88 | 270 | 3.3 |

Underline indicates outside of the range of the present invention or outside of the range of a preferable characteristic value.

TABLE 2C

| | Metallographic structure | | | | | | | | | | | |
|---|---|---|---|---|---|---|---|---|---|---|---|---|
| | | | | | | Prior γ grains | | | | | | |
| | Metallographic structure (vol %) | | Average grain length | Average grain length | Ratio between grain lengths | Average grain length | Average grain length | Ratio between grain lengths | Tensile | Transition temperature | Transition temperature | |
| Test No. | M phase | Residual structure | (L) μm | (C) μm | (C/L) — | (L) μm | (C) μm | (C/L) — | strength MPa | (L) ° C. | (C) ° C. | Note |
| 1 | 98 | 2 | 1.9 | 1.6 | 0.8 | 689 | 112 | 0.16 | 1313 | −99 | −126 | Example |
| 2 | 97 | 3 | 3.5 | 2.8 | 0.8 | 400 | 80 | 0.20 | 1319 | −112 | −127 | Example |
| 3 | 96 | 4 | 3.7 | 1.5 | 0.4 | 218 | 81 | 0.37 | 1341 | −63 | −129 | Example |
| 4 | 95 | 5 | 0.7 | 2.8 | 4.0 | 240 | 64 | 0.27 | 1260 | −117 | −61 | Example |
| 5 | 91 | 9 | 3.0 | 3.6 | 1.2 | 590 | 118 | 0.20 | 1263 | −71 | −62 | Example |
| 6 | 99 | 1 | 15.0 | 9.1 | 0.6 | 44 | 42 | 0.95 | 1031 | −31 | −36 | Comparative Example |
| 7 | 98 | 2 | 1.8 | 5.0 | 2.8 | 1260 | 56 | 0.04 | 1284 | −94 | −62 | Example |
| 8 | 98 | 2 | 4.7 | 3.9 | 0.8 | 242 | 76 | 0.31 | 1201 | −111 | −62 | Example |
| 9 | 97 | 3 | 0.9 | 0.2 | 0.2 | 254 | 92 | 0.36 | 1297 | −66 | −119 | Example |
| 10 | 94 | 6 | 1.8 | 0.6 | 0.3 | 887 | 76 | 0.09 | 1260 | −113 | −109 | Example |
| 11 | 92 | 8 | 1.3 | 2.8 | 2.2 | 549 | 103 | 0.19 | 1195 | −115 | −117 | Example |
| 12 | 98 | 2 | 3.5 | 1.2 | 0.3 | 340 | 85 | 0.25 | 1347 | −89 | −119 | Example |
| 13 | 98 | 1 | 16.0 | 5.1 | 0.3 | 253 | 120 | 0.47 | 1128 | −28 | −15 | Comparative Example |
| 14 | 96 | 4 | 3.4 | 3.9 | 1.1 | 193 | 45 | 0.23 | 1296 | −69 | −96 | Example |
| 15 | 93 | 7 | 4.3 | 2.0 | 0.5 | 1508 | 67 | 0.04 | 1180 | −104 | −106 | Example |

Underline indicates outside of the range of the present invention or outside of the range of a preferable characteristic value.

TABLE 2D

| | Metallographic structure | | | | | | | | | | | |
|---|---|---|---|---|---|---|---|---|---|---|---|---|
| | | | | | | Prior γ grains | | | | | | |
| | Metallographic structure (vol %) | | Average grain length | Average grain length | Ratio between grain lengths | Average vain length | Average grain length | Ratio between grain lengths | Tensile | Transition temperature | Transition temperature | |
| Test No. | M phase | Residual structure | (L) μm | (C) μm | (C/L) — | (L) μm | (C) μm | (C/L) — | strength MPa | (C) ° C. | (C) ° C. | Note |
| 16 | 96 | 4 | 6.7 | 4.9 | 0.7 | 123 | 48 | 0.39 | 1114 | −58 | −77 | Comparative Example |
| 17 | 95 | 5 | 4.4 | 2.0 | 0.5 | 1867 | 56 | 0.03 | 1252 | −101 | −60 | Example |
| 18 | 100 | 0 | 13.2 | 11.8 | 0.1 | 1543 | 120 | 0.08 | 1254 | −42 | −51 | Comparative Example |
| 19 | 97 | 3 | 3.0 | 0.5 | 0.2 | 246 | 69 | 0.28 | 1335 | −95 | −89 | Example |
| 20 | 98 | 2 | 12.3 | 14.2 | 1.2 | 83 | 92 | 1.11 | 1274 | −24 | −18 | Comparative Example |
| 21 | 100 | 0 | 1.3 | 0.8 | 0.6 | 328 | 75 | 0.23 | 1326 | −82 | −71 | Example |
| 22 | 95 | 5 | 1.5 | 0.4 | 0.3 | 140 | 34 | 0.24 | 1217 | −118 | −95 | Example |
| 23 | 95 | 5 | 13.5 | 4.8 | 0.4 | 162 | 85 | 0.52 | 1217 | −62 | −28 | Comparative Example |
| 24 | 95 | 5 | 4.4 | 5.0 | 1.1 | 203 | 54 | 0.27 | 1276 | −90 | −60 | Example |
| 25 | 99 | 1 | 4.3 | 2.4 | 0.6 | 1152 | 72 | 0.06 | 1189 | −117 | −121 | Example |
| 26 | 96 | 4 | 2.8 | 4.3 | 1.5 | 332 | 93 | 0.28 | 1277 | −92 | −129 | Example |
| 27 | 81 | 19 | 3.2 | 4.7 | 1.5 | 277 | 87 | 0.31 | 1003 | −61 | −70 | Comparative Example |
| 28 | 91 | 9 | 3.0 | 3.9 | 1.3 | 334 | 81 | 0.24 | 1307 | −114 | −68 | Example |
| 29 | 97 | 3 | 2.8 | 3.3 | 1.2 | 259 | 111 | 0.43 | 1346 | −103 | −76 | Example |
| 30 | 99 | 1 | 1.9 | 3.5 | 1.8 | 594 | 95 | 0.16 | 1252 | −90 | −95 | Example |
| 31 | 94 | 6 | 0.8 | 3.2 | 4.0 | 170 | 46 | 0.27 | 1130 | −64 | −78 | Comparative Example |
| 32 | 94 | 6 | 3.9 | 1.4 | 0.4 | 432 | 111 | 0.26 | 1289 | −86 | −68 | Example |
| 33 | 96 | 4 | 1.0 | 3.7 | 1.9 | 271 | 62 | 0.23 | 1316 | -61 | −84 | Example |
| 34 | 98 | 7 | 3.1 | 2.9 | 0.9 | 261 | 62 | 0.24 | 1237 | −92 | −94 | Example |
| 35 | 97 | 3 | 1.9 | 4.4 | 2.3 | 220 | 91 | 0.41 | 1029 | −117 | −93 | Comparative Example |
| 36 | 99 | 1 | 2.7 | 1.4 | 0.5 | 1520 | 57 | 0.04 | 1341 | −17 | −31 | Comparative Example |

Underline indicates outside of the range of the present invention or outside of the range of a preferable characteristic value.

In any of the examples shown in Tables 2C and 2D, cooling was performed at an average cooling rate equal to or more than the critical cooling rate V (° C./s), and therefore martensite was contained at 90% or more by vol %. The remainder consisted of one or both of bainite and ferrite. However, in No. 27, as will be described later, martensite was insufficiently generated, and a large amount of bainite was generated.

In addition, as shown in Tables 2C and 2D, the hot rolled steel sheets of the examples became hot rolled steel sheets having a desired tensile strength (1180 MPa or more) and excellent toughness (the ductile-brittle transition temperatures in both the L direction and the C direction were −60° C. or less).

On the other hand, hot rolled steel sheets of comparative examples deviated from the ranges of the present invention did not secure a predetermined tensile strength or did not secure sufficient toughness.

No. 6 is an example in which since the final rolling stand output side temperature was 980° C., accumulation of strain did not occur, and austenite coarsening had occurred, so that a sufficiently refined martensite structure could not be obtained, and the tensile strength and toughness were insufficient.

No. 13 is an example in which since the interpass time between the rolling stand F1 and the rolling stand F2 was long, a sufficiently refined martensite structure could not be obtained, so that the tensile strength and toughness were insufficient.

No. 16 is an example in which since the cumulative rolling reduction at 950° C. or less was less than 70% and sufficient accumulation of strain could not be achieved, a sufficiently refined martensite structure could not be obtained, and the tensile strength and toughness are insufficient.

No. 18 is an example in which since the A value was less than 0.05 during rolling in the first pass (F1), the dislocation density introduced into austenite at the time of the rolling decreased, so that a sufficiently refined martensite structure could not be obtained and the toughness was insufficient.

No. 20 is an example in which since the time until the start of cooling after the finish rolling was long, strain introduced into austenite was released, so that a sufficiently refined martensite structure could not be obtained, and the toughness was insufficient.

No. 23 is an example in which since the interpass time between the rolling stand F1 and the rolling stand F2 was long, strain introduced into austenite was released, so that a sufficiently refined martensite structure could not be obtained, and the toughness was insufficient.

No. 27 is an example in which since the winding temperature which is the cooling stop temperature exceeded 300° C. even though cooling was performed at a cooling rate equal to or more than the martensite critical rate V (° C./s), martensite was not sufficiently generated and the tensile strength was insufficient.

No. 31 is an example in which the A value exceeded 23.0 during rolling in the seventh pass (F7), large deformation heating had occurred, the final rolling stand output side temperature increased, and some strain was released until the start of the cooling, so that the tensile strength was insufficient.

No. 35 is an example in which since the C content in the steel was lower than a predetermined compositional range, the tensile strength was insufficient.

No. 36 is an example in which since the Ti content in the steel was higher than a predetermined compositional range and precipitates such as coarse TiC and TiN were generated, the toughness was insufficient.

What is claimed is:

1. A hot rolled steel sheet comprising, as a chemical composition, by, mass %:

C: 0.06% or more and 0.20% or less;
Si: 1.0% or less;
Mn: more than 1.5% and 3.5% or less;
P: 0.040% or less;
S: 0.004% or less;
Al: 0.10% or less;
N: 0.004% or less;
Ti: 0.04% or more and 0.20% or less;
Nb: 0% or more and 0.04% or less;
Mo: 0% or more and 1.0% or less;
Cu: 0% or more and 0.5% or less;
Ni: 0% or more and 0.5% or less; and
a remainder consisting of Fe and impurities, wherein a metallographic structure at a sheet thickness ¼ depth position and a sheet width center position of the hot rolled steel sheet consists of 90 vol % or more martensite and 0 vol % or more and 10 vol % or less of a residual structure, the residual structure is one or both of bainite and ferrite, an average length of grains in an L direction, which is a direction parallel to a rolling direction, is 0.2 μm or more and 5.0 μm or less, an average length of grains in a C direction, which is a direction parallel to a transverse direction, is 0.1 μm or more and 5.0 μm or less, a ratio between an L direction grain length, which is the average length of the grains in the L direction, and a C direction grain length, which is the average length of the grains in the C direction, is 0.2≤C direction grain length/L direction grain length ≤5.0, and a tensile strength is 1180 MPa or more.

2. The hot rolled steel sheet according to claim 1, wherein, in the metallographic structure at the sheet thickness ¼ depth position and the sheet width center position, when an average length of prior austenite grains in the L direction is referred to as an L direction prior γ grain length and an average length of prior austenite grains in the C direction is referred to as a C direction prior γ grain length, a ratio between the L, direction prior γ grain length and the C direction prior γ grain length is 0.03≤C direction prior γ grain length/L direction prior γ grain length ≤0.40.

3. The hot rolled steel sheet according to claim 1, further comprising, in the chemical composition, by mass %:

one or two or more selected from the group consisting of
Nb: 0.01% or more and 0.04% or less,
Mo: 0.01% or more and 1.0% or less,
Cu: 0.01% or more and 0.5% or less, and
Ni: 0.01% or more and 0.5% or less.

4. A method for manufacturing the hot rolled steel sheet according to claim 1, comprising steps (a) to (d) of:

(a) a heating step of heating a steel material having the chemical composition according to claim 1 to 1200° C. or higher and 1350° C. or lower;

(b) a finish rolling step of performing rolling by continuously passing the steel material after being heated through a plurality of rolling stands, a finish rolling start temperature being set to 800° C. or higher, the rolling being performed so as to cause an A value defined by Formula (1) in each of the rolling stands to satisfy 0.05≤A≤23.0, an interpass time between the rolling stands being set to 0.2 seconds or longer and 10.0 seconds or shorter, a final rolling stand output side temperature being set to 800° C. or higher and 950° C. or lower, a cumulative rolling reduction in 800° C. or higher and 950° C. or lower being set to 70% or higher;

(c) a cooling step of starting cooling within 10.0 seconds after the finish rolling and performing cooling at an average cooling rate equal to or higher than a martensite generation critical cooling rate V by ° C./s determined by Formulas (2) and (3); and (d) a winding step of performing winding at a winding temperature of 300° C. or lower after the cooling,

[Formula 1]

$$A = \frac{2\pi n}{60\sqrt{rH}} \ln\left(\frac{1}{1-r}\right) \quad (1)$$

$$V = 10^{2.94-0.75(\beta-1)} \quad (2)$$

$$\beta = 2.7 \times C + 0.4 \times \mathrm{Si} + \mathrm{Mn} + 0.45 \times \mathrm{Ni} + \mathrm{Mo} \quad (3)$$

where n in Formula (1) is a roll rotation speed by rpm, r is a rolling reduction by %, H is a rolling input side sheet thickness by mm, C, Si, Mn, Ni, and Mo in Formula (3) are amounts of the corresponding elements by mass %, and 0 mass % is substituted into terms Ni and Mo in a case where Ni and Mo are not contained.

* * * * *